US008022627B2

(12) United States Patent
Stockwald

(10) Patent No.: US 8,022,627 B2
(45) Date of Patent: Sep. 20, 2011

(54) ELECTRODELESS HIGH PRESSURE DISCHARGE LAMP

(75) Inventor: Klaus Stockwald, Germering (DE)

(73) Assignee: OSRAM AG, Munich (DE)

( * ) Notice: Subject to any disclaimer, the term of this patent is extended or adjusted under 35 U.S.C. 154(b) by 37 days.

(21) Appl. No.: 12/720,769

(22) Filed: Mar. 10, 2010

(65) Prior Publication Data

US 2010/0231127 A1 Sep. 16, 2010

Related U.S. Application Data

(60) Provisional application No. 61/159,040, filed on Mar. 10, 2009.

(51) Int. Cl.
*H01J 11/00* (2006.01)

(52) U.S. Cl. ..... 313/567; 313/594

(58) Field of Classification Search ..... 313/25, 313/567, 594, 238, 252
See application file for complete search history.

(56) References Cited

U.S. PATENT DOCUMENTS

| | | | |
|---|---|---|---|
| 5,299,100 | A | 3/1994 | Bellows et al. |
| 2009/0146543 | A1 | 6/2009 | Chang et al. |

FOREIGN PATENT DOCUMENTS

| | | | |
|---|---|---|---|
| EP | 0897191 | A2 | 4/1999 |
| EP | 0940842 | A2 | 2/2000 |
| EP | 0897190 | A2 | 7/2000 |

OTHER PUBLICATIONS

British Search Report dated Jul. 1, 2010.

*Primary Examiner* — Vip Patel

(57) ABSTRACT

An electrodeless high pressure discharge lamp is described. The lamp includes a resonating body configured to provide microwave energy and a discharge vessel, the discharge vessel containing a fill that forms a light-emitting plasma when receiving the microwave energy. The lamp further includes an outer bulb surrounding the discharge vessel. The lamp further includes a support structure within the outer bulb, the support structure comprising a plurality of wires forming a cage, wherein each end of each of the plurality of wires are directed to either end of the discharge vessel. The lamp further includes a first wire structure configured to hold the discharge vessel in place within the cage and surrounding each end of the discharge vessel.

1 Claim, 7 Drawing Sheets

ELECTRODELESS HIGH PRESSURE DISCHARGE LAMP

RELATED APPLICATIONS

The present application claims the benefit of U.S. provisional application Ser. No. 61/159,040 filed Mar. 10, 2009, the disclosure of which is incorporated herein by reference in its entirety.

TECHNICAL FIELD

Embodiments of the invention relate to electrodeless high pressure discharge lamps (EHID) with an outer bulb, in particular EHIDs intended for general illumination or photo-optical applications.

BACKGROUND

US Patent Application No. 20090146543 discloses a plasma lamp. The lamp is based on electrodeless high pressure discharge lamps which are often referred to as EHID. US Patent Application No. 20090146543 is incorporated by reference.

SUMMARY

Embodiments provide an improved EHID lamp and include the following features.

An electrodeless high intensity metal halide lamp with an electrodeless vessel positioned in an evacuated or gas-filled outer bulb is disclosed.

Embodiments provide an electrodeless high pressure discharge lamp. The EHID lamp includes a resonating body configured to provide microwave energy and a discharge vessel, the discharge vessel containing a fill that forms a light-emitting plasma when receiving the microwave energy. The lamp further includes an outer bulb surrounding the discharge vessel and a support structure within the outer bulb, the support structure comprising a plurality of wires forming a cage, wherein each end of each of the plurality of wires are directed to either a first or a second end of the discharge vessel. The lamp further includes a first wire structure, and a second wire structure, wherein the first end and the second end of the discharge vessel are respectively surrounded by the first and the second wire structure, the first and the second wire structure are configured to hold the discharge vessel in place within the cage, the first wire structure being connected to the ends of the plurality of wires directed to the first end of the discharge vessel, and the second wire structure being connected to the ends of the plurality of wires directed to the second end of the discharge vessel.

Ceramic HID vessels are typically excited by an electroded or electrodeless method show highest efficacy for metal halide fills when they are operated in a closed environment, which defines the thermal arc tube behavior.

Embodiments include the use of an outer transparent bulb, at least over a visual spectral part, in which the arc tube is assembled.

The outer bulb can be evacuated or filled by a gas or gas mixture for controlled thermal management. The bulb may have a coating and a feedthrough for the power feed to the vessel. The bulb may contain an applicator construction.

Electrodeless high intensity discharge (EHID) bulbs today are mainly made of quartz and operated in contact with a heat sink or in air or have to be cooled by forced cooling.

The ceramic arc tube is mainly radiation cooled by emitted NIR-emission, which represents the highest efficient operation mode for a metal halide discharge lamp. Especially for low power applications the power efficiency for heating the arc tube vessel for adjustment of the metal halide vapor pressure has to be maximized and heat losses have to be minimized. This can only be accomplished by the use of a loose thermal coupling of the arc tube and the surrounding.

The outer bulb may be built as a thin-walled quartz sleeve with distant supports around the arc tube vessel. The outer bulb in these cases has a very small gap at portions where the applicator is attached to the outer vessel. In case of the applicator is built into the outer bulb, the outer bulb has a higher volume and has at least one feedthrough for the power-RF-feed, which may be a transmission line or strip or coaxial line, into the inside of the outer bulb. This may be included by pinching or sealing of by soldering with a glass frit. The feedthrough portion has an exhaust opening which may be closed afterwards.

The fill may comprise several parts.

A gaseous part of the fill which has gaseous form under normal conditions. This means the temperature range in-between −20 up to 20° C. Said fill part contains ionisable components:

This may be a mixture of:

Proportion 1:

(a) inert rare gases typically in the pressure range of 0.1 mbar to 10000 mbar, typically 5 to 500 mbar. Examples are Kr, Ar, Xe, Ne.

(b) molecular gases in the range of a proportion of at least 250 ppm. preferably these are the following gases alone or in combination: D2, H2, DH; CO, CO2, N2O, SF6, Cl2, J2, Br2, N2, acetylene, or other organic gases, esp. methane, propane, butane or the like. The Amount of gases (b) is preferably in the range of about 250 ppm to 5000 ppm.

Proportion 2: In addition the fill may comprise a non-gaseous part with low vapor pressure at standard conditions. This non-gaseous part comprises alone or in combination:

(a) a first part consisting of a elemental metal which is dosed as a metal drop or chip wire or sphere or powder or evaporated coating:

Hg, Zn, Tl, Mg, Mn, In, W, Rh, Re, Ir, Os, Mo, Nb, Sn, Ga, Al, or the like.

Typically if dosed intentionally it should be dosed in a concentration of at least 0.1 mg/cm$^3$. A preferred range is 1 to 10 mg/cm$^3$. A typical amount is in the range of 0.2 to 200 μmol/cm$^3$ (b) a second part consisting of a metal halide mixture. this might be divided up in:

(b1) at least one or a group of metal halides with high volatility typically with a boiling point in the range below 950° C. Preferred embodiments are halides of the following metals alone or in combination: Zn, In, Tl, Mn, Mg, Al, Sn, Hf, Zr, Ta, Nb, V, Sb, Ga, Cu, Fe, or the like.

(b2) at least one or a group of metal halides with low volatility with a boiling point in the range of at least 950° C. Preferred embodiments are rare earth-halides or lanthanoide-halides, esp. of Y, Sc, La, alkali-metal halides.

(b3) at least one or a group of oxides which may serve as a donator of oxygen; preferred embodiments are Al2O3, CaO, or the like;

(b4) at least one or a group of metal-organic agents like acetylides of Cu, Fe, In, or the like;

(b5) at least one or a group of chalcogenes, preferably Te, Se, S, or/and chalcogenides like TeS, SeS, and so on. A typical amount of second part (b) is in the range of 0.2 to 200 μmol/cm$^3$.

The EHID lamp system of the invention is composed of a discharge vessel, a coupling arrangement for high frequency coupling into the gas filled discharge vessel and an outer bulb.

The arc tube may for use in EHID system of the invention can have different inner and outer shape, see FIG. 1.

Typically for longitudinal electric field ignition and longitudinal electric driving field strength the lamp has an elongated structure around an axis with symmetric ends. Typically the aspect ratio A of the inner volume, which is A=IL/ID with inner length IL divided by inner diameter ID, are typically A≧1, most preferably A≧1,5 and is in a range preferably up to A=8.

Preferably the arc tube has a tubular or pill shape. It can be made preferably from alumina ceramics or glass ceramic or quartz glass. Especially the lamp vessel can be The arc may be placed in an outer bulb which is filled with gas or which is evacuated.

Preferably the arc tube for use in an EHID system according to embodiments may have a different inner and outer shape, see FIG. 1. Typically for longitudinal electric field ignition and longitudinal electrical driving field strength the lamp has an elongated structure around an axis with symmetric ends.

Typically the aspect ratio AR between inner length IL and inner diameter ID of the inner volume (IL/ID) of the discharge vessel is typically AR≧1, most preferable is AR≧1.5 and especially it should not be higher than AR=8.

The vessel shape can be cylindrically or partly cylindrical in the central part of the lamp extension, but can have different end shapes which may be thinned at the end portions.

If the arc tube vessel is thinned at the end portions applicator structures may be attached in these areas.

Other shapes which are tapered or spheroid shaped may also be used for optimizations of the thermal behavior and the fill or plasma shape.

Typical the material of the discharge vessel is made of mainly densely sintered polycrystalline ceramic like PCA (alumina), Yttria; YAG, PCD (dysprosia), AlN, AlON or the like.

For sealing at least one of the end portions, ceramic glass frits, typically mixtures of oxides, are used.

Typically for the wall load of the arc tube on the inside referred to the RF input power into the lamp, ranges from 10-60 W/cm$^2$, more favorable in the range of 15-40 W/cm$^2$ and the outer wall load ranges typically in the range of 10-30 W/cm$^2$.

The wall load along the total area where the plasma is created, which may be a shorter length compared to the maximum inner length, ranges on the inside from 20-120 W/cm$^2$, more favorable in the range of 30-80 W/cm$^2$ and on the outer wall in the range of 20-60 W/cm$^2$.

The fill of the discharge vessel has a fill that can be ionized and contains at least a gaseous component in the cold non-operational condition.

Typically it contains several components which may be vaporized during operation and build up a stable vapour pressure at operational conditions.

The typical pressure under these conditions is at least 0.5 bar and the system can be considered to build up a high pressure discharge.

DESCRIPTION

FIGS. 1 to 8 show schematically a PCA discharge vessel. It can be of different shape. FIGS. 1 to 8 show preferred shapes of vessels 1. Al2O3-ceramic is a preferred material.

Figure 1:
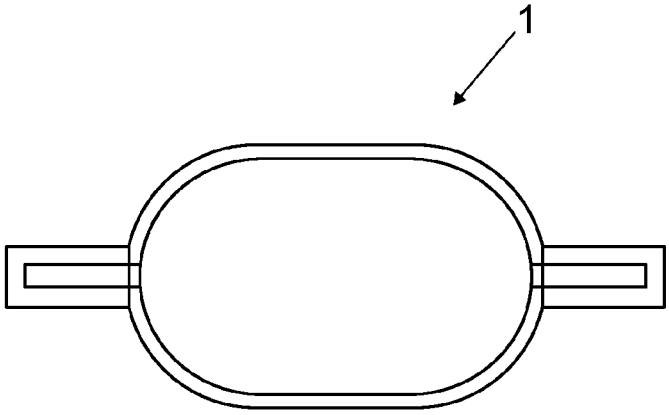
FIGS. 1-8 show several shapes for EHID discharge vessels according to embodiments.
Figure 2:
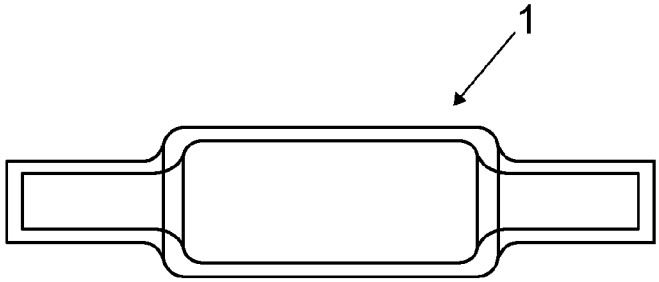
Figure 3:
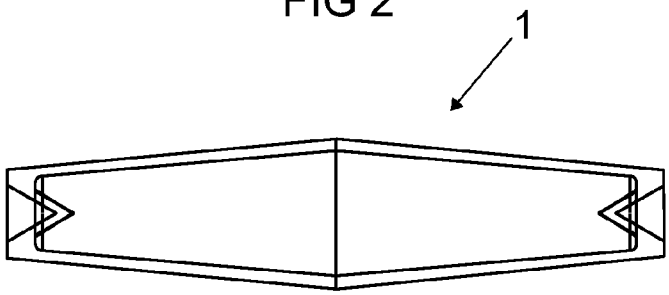
Figure 4:
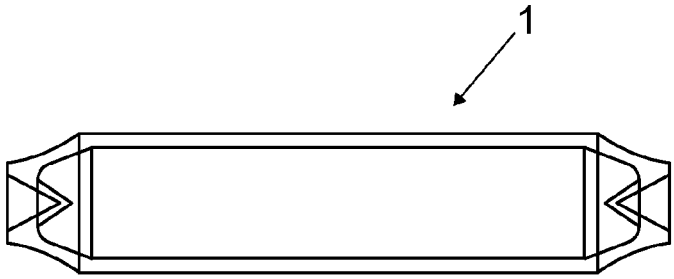
Figure 5:
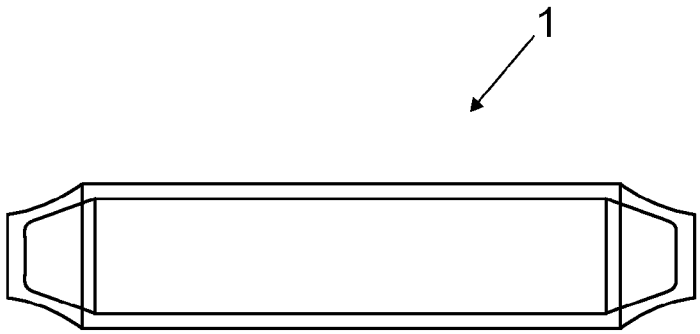
Figure 6:
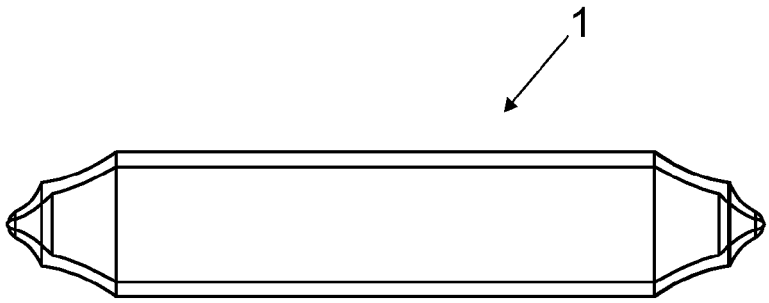
Figure 7:
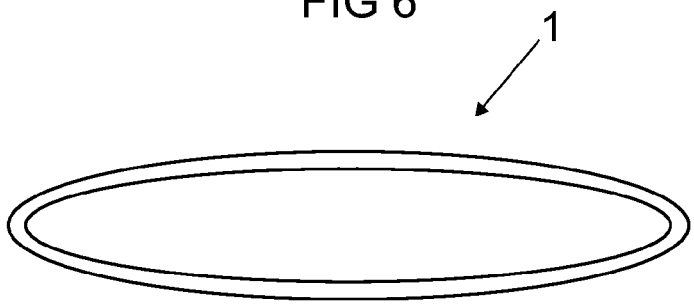
Figure 8:
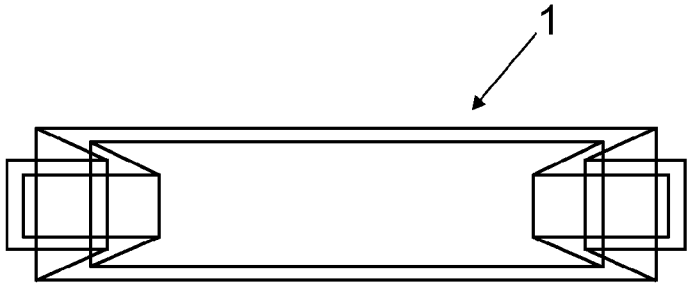
Figure 9A:
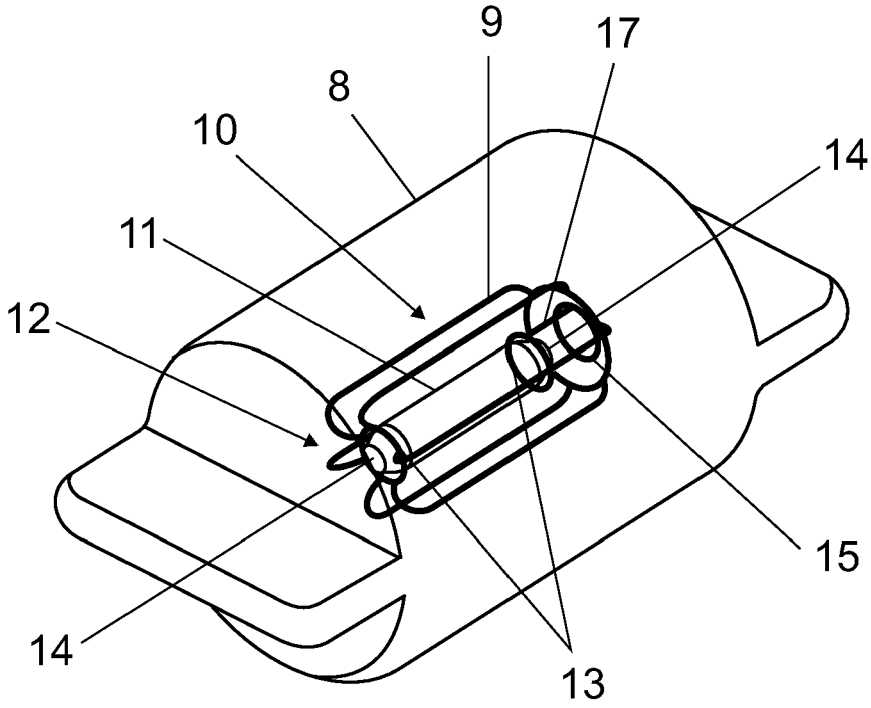
FIG. 9*a* shows an outer bulb, a cage support, and discharge vessel according to an embodiment.
Figure 9B:
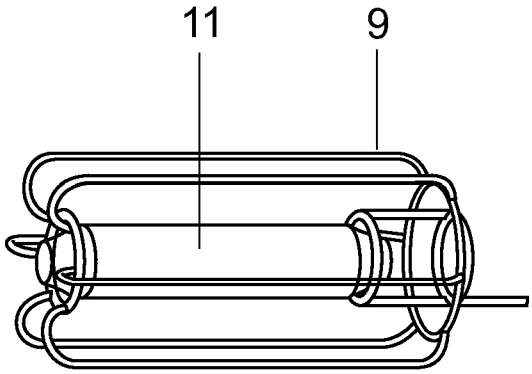
FIG. 9*b* shows a cage support, and discharge vessel according to an embodiment.

FIG. 9*a* and detail of FIG. 9*b* shows a lamp with an EHID arc tube 11 within an outer bulb 8. The inner bulb 11 may be supported by a cage 10 with cage wires 9. The cage 10 comprises six wires 9 in parallel to the axis of the tubular discharge vessel 11. Their ends 12 are bent towards the direction of the first and second ends of the discharge vessel. Two rings 13 made from a wire surround tapered ends 14 of the discharge vessel. The first ends 12 of the cage wires 9 are connected to the first ring 13 at the first end of the discharge vessel. The second ends 12 of the cage wires 9 are connected to a third ring 15 of wire which is arranged in within the wall of the outer bulb. This ring 15 is connected to the second ring 13 surrounding the second end of the discharge vessel by means of several wires 17 aligned in parallel and parallel to the axis of the discharge vessel.

Figure 10:
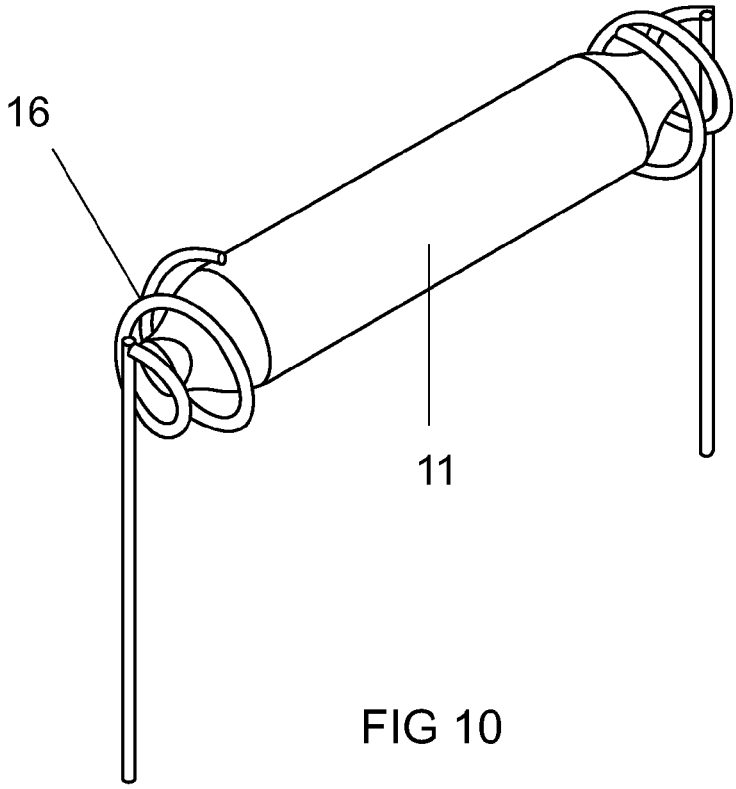
FIG. 10 shows a support structure and discharge vessel according to an embodiment.

The inner bulb 11 may be held in place by a special end construction 16 with a coating, see embodiment of FIG. 10. the end construction is like a coil.

The whole lamp may comprise the following features:

(a) a waveguide having a body of a preselected shape and dimensions, the body comprising at least one dielectric material and having at least one surface determined by a waveguide outer surface, each said material having a dielectric constant greater than approximately 2;

(b) a first microwave probe positioned within and in intimate contact with the body, adapted to couple microwave energy into the body from a microwave source having an output and an input and operating within a frequency range from about 0.25 GHz to about 30 GHz at a preselected frequency and intensity, the probe connected to the source output, said frequency and intensity and said body shape and dimensions selected so that the body resonates in at least one resonant mode having at least one electric field maximum;

(c) the body having a lamp chamber depending from said waveguide outer surface and determined by a chamber aperture and a chamber enclosure determined by a bottom surface and at least one surrounding wall surface;

(d) a transparent, dielectric bulb within the lamp chamber; and (e) a fill mixture contained within the bulb which when receiving microwave energy from the resonating body forms a light-emitting plasma wherein the fill comprises organic compounds chosen from a group which comprises acetylene, methane, propane, butane, and acetylides.

More generally an electrodeless high pressure discharge lamp is disclosed comprising a fill contained within a discharge vessel which when receiving microwave energy from a resonating body forms a light-emitting plasma wherein a support structure within an outer bulb is made of cage wires wherein the ends of the wires are directed to the ends of the discharge vessel and wherein the ends of the discharge vessel are surrounded by a wire-like structure to hold the discharge vessel in place the structure being connected to the ends of the wires.

There is a multitude of different applicator structures possible to apply high frequency power to the bulb. Single examples are given for explanation purposes and are not to scale.

Embodiments include a power applicator that is constructed in a way to have a weak thermal coupling to the discharge vessel in order to allow the vessel to control the heat transfer mainly by surface radiation and radiation interaction with the environment.

By this the highest efficiency of conversion of electrical power to the discharge and into radiation is given.

A feedthrough system is arranged in the bulb wall, depending on the feed transmission line arrangement.

The outer bulb can be made as small as possible for containing the vessel mounted into a power applicator. The outer bulb can be evacuated and may contain a getter system for vacuum purification.

Alternatively the outer bulb may contain a gas for transfer heat to the outer bulb in a controlled way. Under these circumstances the gas may contain molecular gases, e.g. N2 or N2O, CO2 or the like and mixtures with rare gases for controlling the heat exchange rate in between arc tube vessel and the outer bulb. The bulb size is then dimensioned for an exchange of the outer wall with the environment, especially ambient atmosphere.

The used feedthrough system may be especially designed for impedance matching of the feeding power system to the vessel in the applicator.

The applicator in the vessel can be matched by an impedance matching network placed inside of the outer bulb.

Figure 11:
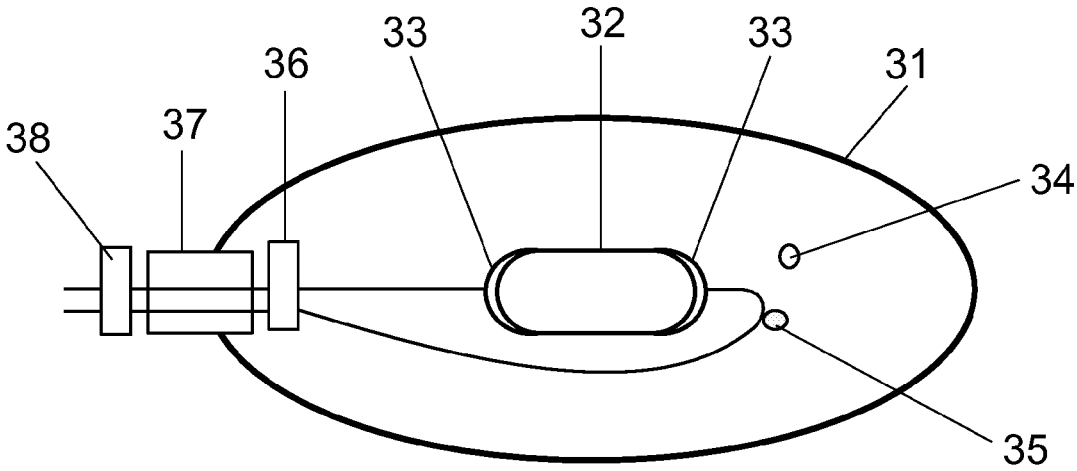
FIG. 11 shows an outer bulb, discharge vessel, and a coupler according to an embodiment.

FIG. 11 shows a EHID lamp with an outer bulb 31, which may comprised of doped, especially UV-blocking, quartz glass. The discharge vessel is 32, it may be comprised of ceramic. The applicator arrangement 33 is for example a cage applicator. Inside the outer bulb there is a gas fill 34 or vacuum (schematic). Inside the outer bulb there is also placed a getter system 35 for long term maintenance of outer gas fill.

The matching network 36 is inside of the outer bulb. There is a feedthrough 37 in the outer bulb 31 and a matching network 38 for matching power line to EHID lamp.

Figure 12:
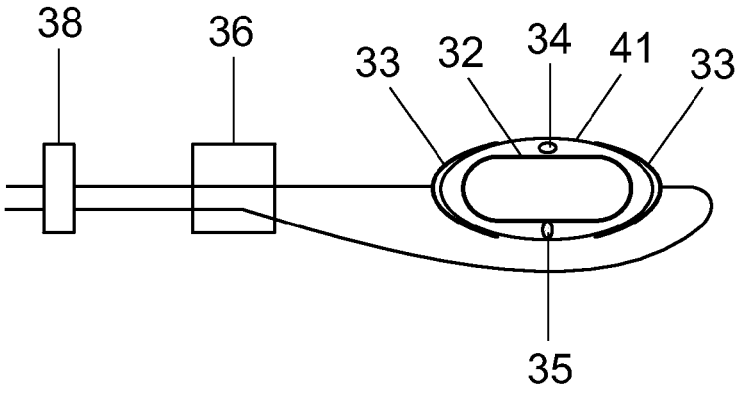
FIG. 12 shows an outer bulb, discharge vessel, and a coupler according to an embodiment.

FIG. 12 discloses an alternative where the outer vessel 41 is placed around a small quartz vessel 32 with small clearance in between outer bulb and arc tube vessel, possibly held by dielectric distant springs or dielectric transparent tiny distant holders which may be formed into the outer bulb or the arc tube vessel.

Under these circumstances the getter 35 is attached or coated on the outer bulb 41 or to distant assembly holders of the lamp construction. The closed system may be evacuated or filled by a gas or gas mixture for controlled heat transfer to the ambient environment.

The matching network 36 is outside of the outer bulb. There is a matching network 38 for matching power line to EHID lamp.

The EHID components comprise:
- coating on the arc tube
- coupler structure
- fill within the arc tube
- design of the arc tube
- mounting structure
- outer bulb structure
- electronic solid-state power supply.

Especially the arc tube design comprises an ceramic arc tube. Its shape may be cylindrical, or cylindrical with special shape of the end, or similar to a spheroid. Examples for the shape of the end are re-entrant end-portions and narrowing end-portions with thinner wall compared to the wall thickness of the main portion. Examples for spheroidical shape are Powerball-like and rugby-ball-like.

The material of the arc tube may be mainly or alone: aluminates or oxides or nitrides or PCA which means polycrystalline crystalline alumina or other polycrystalline materials, or amorphous materials. An alternative are material mixtures like PCA plus glass ceramic or PCD, yttria, AlON, plus glass ceramic.

The arc tube may be provided with an inner coating.

The mounting structure may be:
- integral part of the coupler structure
- separate from the coupler structure The properties of the mounting structure may include:
- low thermal coupling to arc tube
- mechanical positioning and fastening
- equalizing thermal cycling
- the structure may be integral part of the optical system for guiding of emitted light.

The outer bulb structure may have the following features:
- fill in the outer bulb may be vacuum, a low pressure fill or a high pressure fill like nitrogen.

The shape of the outer bulb may be accommodated for reflexion of NIR and/or UV and/or VIS.

The shape of the outer bulb may be accommodated for optical guiding of emitted light.

A coating may be applied to the outer bulb. An inner coating is preferably for reflexion of most part of NIR and/or UV and/or VIS or for partly reflecting in these ranges. An outer coating may preferably be apt for shielding purposes or for at least partial reflecting like a mirror.

In case of an integral applicator connected with the outer bulb a strip-line feedthrough may be used. An example is shown in FIG. 13. The outer bulb may have a shielding or coating. A ceramic arc tube is held inside of an outer bulb made of quartz glass which is supported for application of an applicator structure inside the outer bulb. Support parts within the outer bulb can be made of quartz or glass or material with low dielectricity constant $\in_r$. Low dielectricity constant means here an $\in_r$ of 4,5 at maximum. The support parts may have small wall thickness for low thermal coupling. Examples are quartz glass with $\in_r$ of between 3,7 and 4,5 (boundaries enclosed). Another example is alumina with $\in_r$ is about 10; or teflon with $\in_r$=about 2,1 or polyethylene with $\in_r$ is about 2,25.

An embodiment is a tubular ceramic arc tube within an evacuated outer bulb. An ignition aid is axially aligned and directs to the one end of the arc tube. The arc tube is surrounded by cage waveguide.

A further embodiment is a ceramic arc tube inside of an quartz made outer bulb which is supported for application of an applicator structure on the extended outside of an outer bulb. The quartz-made outer bulb should be thin-walled.

Figure 13A:
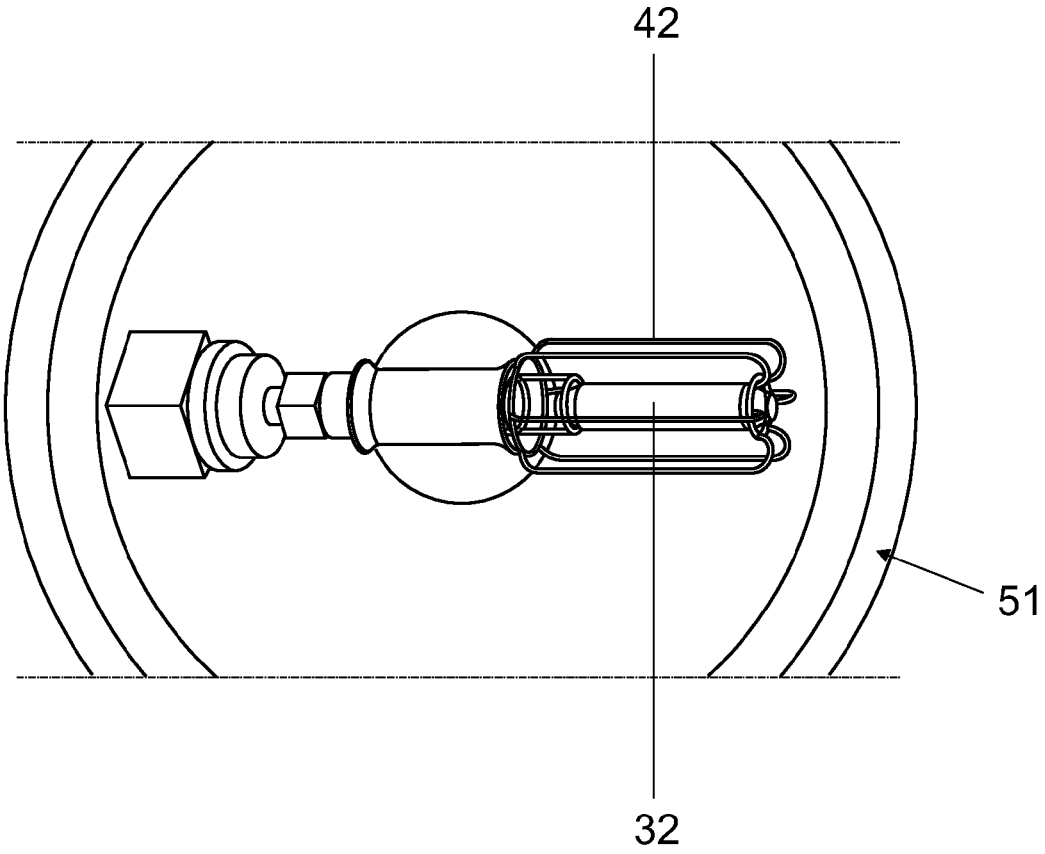
FIGS. 13*a*-13*c* show a discharge vessel and a reflector in different views according to an embodiment.

FIG. 13*a* shows a reflector-type EHID lamp with cage wires 42 holding the vessel 32. The cage wires are held by an applicator which in turn is fixed to a feed through element. The whole set is to be inserted in the central neck of a concave reflector 51.

Figure 13B:
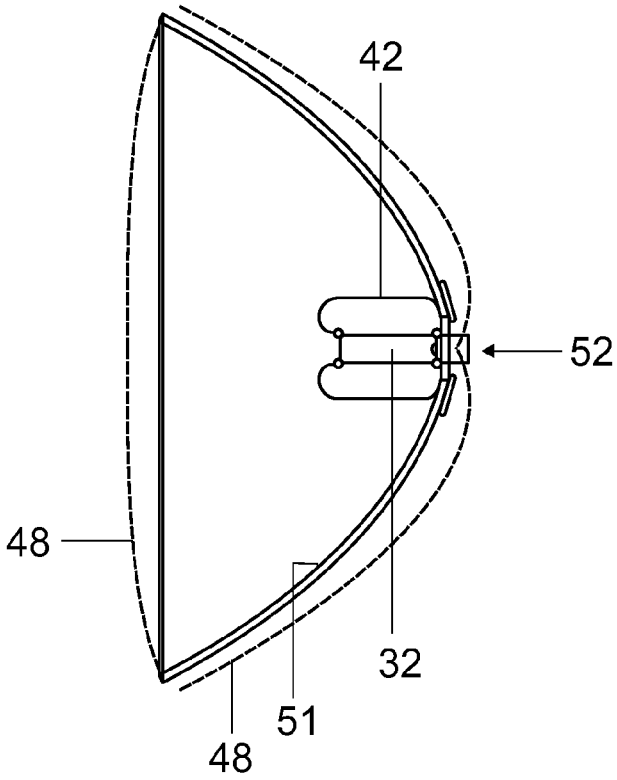
Figure 13C:
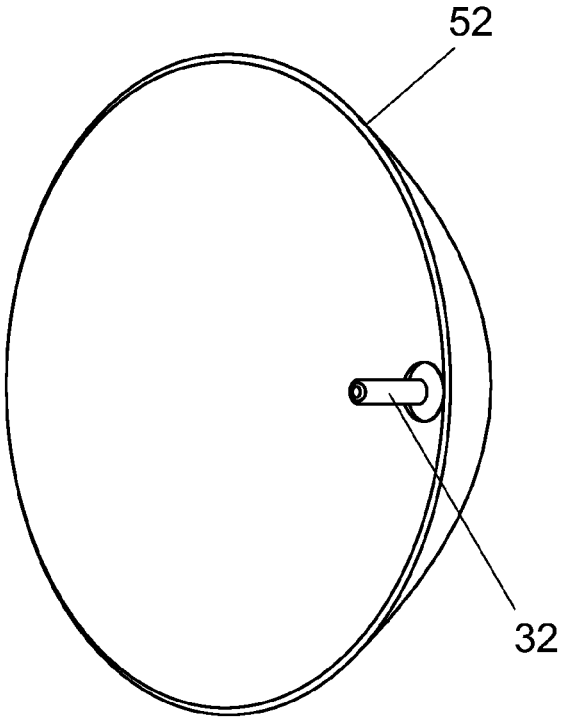

FIG. 13*b* shows EHID optics for separated wave guide feed. FIG. 13*c* shows a concave reflector contour 52, with a central opening in its neck, where the arc tube 32 is inserted. The arc tube is surrounded by a cage-like coupler structure 42, see FIG. 13*b*. The reflector material may be used as a printed circuit board (PCB). On the concave reflector housing there may be a shielding or a coating 48 applied thereto.

Figure 14A:
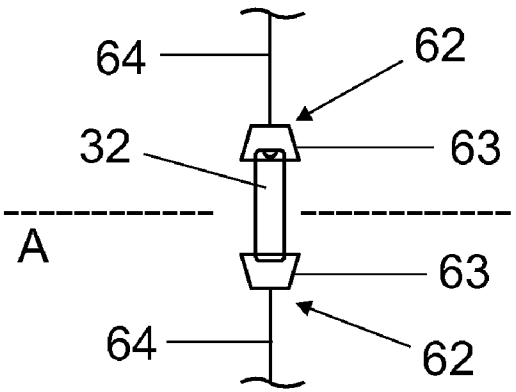
FIGS. 14*a* and 14*b* show still another embodiment with a reflector.
Figure 14B:
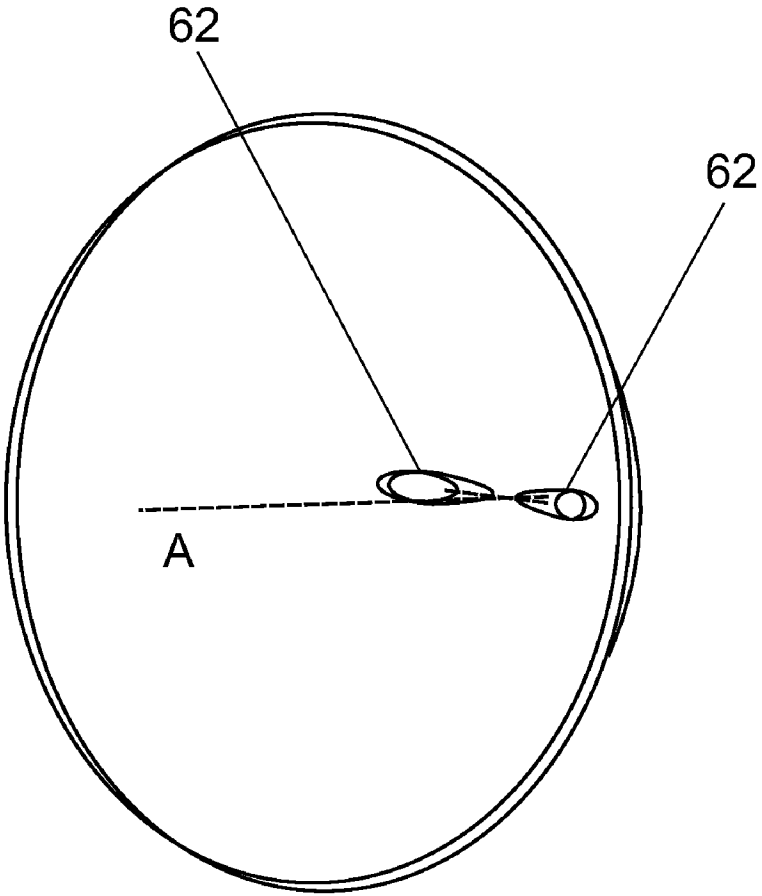

FIGS. 14*a* and 14*b* show another embodiment for EHID optics for separated wave guide feed. The concave reflector part 61 has two openings 62 symmetrically to the center. The arc tube 32 is oriented across the longitudinal axis A of the reflector 61. The arc tube is held in position by rod-/coil-/antenna-winding 63 as coupling structure. From the coupling structure there extends a waveguide feed 64 which is a strip line or coaxial line.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. An electrodeless high pressure discharge lamp comprising:

a resonating body configured to provide microwave energy;

a discharge vessel, the discharge vessel containing a fill that forms a light-emitting plasma when receiving the microwave energy;

an outer bulb surrounding the discharge vessel;

a support structure within the outer bulb, the support structure comprising a plurality of wires forming a cage, wherein each end of each of the plurality of wires are directed to either a first or a second end of the discharge vessel;

a first wire structure; and a second wire structure, wherein:

the first end and the second end of the discharge vessel are respectively surrounded by the first and the second wire structure, the first and the second wire structure are configured to hold the discharge vessel in place within the cage, the first wire structure being connected to the ends of the plurality of wires directed to the first end of the discharge vessel, and the second wire structure being connected to the ends of the plurality of wires directed to the second end of the discharge vessel.

* * * * *